US011834298B2

(12) United States Patent
Haapaniemi et al.

(10) Patent No.: US 11,834,298 B2
(45) **Date of Patent: *Dec. 5, 2023**

(54) METHOD FOR MODERNIZING ELEVATOR SYSTEM

(71) Applicant: KONE Corporation, Helsinki (FI)

(72) Inventors: Markku Haapaniemi, Helsinki (FI); Matti Räsänen, Helsinki (FI); Tarvo Viita-aho, Helsinki (FI); Petri Kere, Helsinki (FI); Janne Laine, Helsinki (FI); Jari Österman, Helsinki (FI); Jorma Mustalahti, Helsinki (FI); Anssi Venho, Helsinki (FI); Jori Hägg, Helsinki (FI); Otto Lanz, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 17/888,119

(22) Filed: Aug. 15, 2022

(65) Prior Publication Data

US 2022/0388814 A1 Dec. 8, 2022

Related U.S. Application Data

(63) Continuation of application No. 17/201,517, filed on Mar. 15, 2021, now Pat. No. 11,414,303.

(30) Foreign Application Priority Data

Apr. 27, 2020 (EP) ..... 20171548

(51) Int. Cl.
*B66B 19/00* (2006.01)
*B66B 5/00* (2006.01)

(52) U.S. Cl.
CPC ..... *B66B 19/007* (2013.01); *B66B 5/005* (2013.01)

(58) Field of Classification Search
CPC ..... B66B 19/007; B66B 5/005; B66B 19/04
See application file for complete search history.

(56) References Cited

U.S. PATENT DOCUMENTS 7,635,049 B2 * 12/2009 Van Der Meijden ..... B66B 19/002 187/401
8,291,568 B2 * 10/2012 Barneman ..... B66B 19/00 29/431

(Continued)

FOREIGN PATENT DOCUMENTS

WO WO 2012/123646 A1 9/2012
WO WO 2019/068469 A1 4/2019

OTHER PUBLICATIONS

Search Report issued in European priority application 20171548.9, dated Oct. 19, 2020.

*Primary Examiner* — Michael A Riegelman
(74) *Attorney, Agent, or Firm* — Birch, Stewart, Kolasch & Birch, LLP

(57) ABSTRACT

A method for modernizing an elevator system, includes using a first and second car for transporting passengers and/or goods between vertically displaced floors of a building, and thereafter removing the first elevator car from use for transporting passengers and/or goods between vertically displaced floors, and thereafter installing a construction time elevator into the lower end of the first hoistway, the traveling zone of the car of the construction time elevator covering only partially the height of the first hoistway; and thereafter using the car of the construction time elevator and the second car simultaneously for transporting passengers and/or goods between vertically displaced floors of the building, during which using the method includes performing construction work in the first hoistway above the traveling zone of the car of the construction time elevator; and thereafter (Continued)

changing the traveling zone of the car of the construction time elevator to extend higher in the hoistway, and thereafter using the car of the construction time elevator and the second car simultaneously for transporting passengers and/or goods between vertically displaced floors, during which using the method comprises performing construction work in the first hoistway above the traveling zone of the car of the construction time elevator.

22 Claims, 9 Drawing Sheets

(56) References Cited

U.S. PATENT DOCUMENTS

| | | | | |
|---|---|---|---|---|
| 11,208,296 | B2 * | 12/2021 | Christen | B66B 19/002 |
| 11,414,303 | B2 * | 8/2022 | Haapaniemi | B66B 19/007 |
| 2010/0018809 | A1 * | 1/2010 | Peacock | B66B 19/00 187/351 |
| 2010/0133048 | A1 * | 6/2010 | Barneman | B66B 19/00 187/414 |
| 2012/0291395 | A1 * | 11/2012 | Plathin | B66B 19/02 52/741.1 |
| 2015/0307322 | A1 * | 10/2015 | Peacock | B66B 7/064 187/254 |
| 2016/0152442 | A1 * | 6/2016 | Weber | B66B 19/005 187/359 |
| 2018/0290863 | A1 * | 10/2018 | Peacock | E04G 3/32 |
| 2020/0277158 | A1 * | 9/2020 | Christen | B66B 5/284 |
| 2021/0331898 | A1 * | 10/2021 | Haapaniemi | B66B 5/005 |

* cited by examiner

METHOD FOR MODERNIZING ELEVATOR SYSTEM

CROSS-REFERENCE TO RELATED APPLICATIONS

This application is a Continuation Application of U.S. application Ser. No. 17/201,517, filed Mar. 15, 2021, which claims priority under 35 U.S.C. § 119(a) to application no. 20171548.9, filed in the European Patent Office on Apr. 27, 2020. The contents of each of the above-identified applications are incorporated herein by reference.

FIELD OF THE INVENTION

The invention relates to a method for modernizing an elevator system comprising plurality of elevators. Each said elevator is preferably an elevator for transporting passengers and/or goods.

BACKGROUND OF THE INVENTION

After long term use, elevators get out of date and they need to be modernized, e.g. so as to increase safety, efficiency or ride comfort, for instance. Modernizing an elevator is often made by replacing all components of the existing elevator. Typically, however the hoistway and machine room are left at their original places.

Usually in tall buildings, there are two or more parallel elevators operating in a group and serving one or more common floors. There may be many such groups in the same building. In prior art, when a time comes that elevators of a group need to be modernized, they are each modernized one by one. The common way to modernize an elevator has been to take the elevator out of use and thereafter to remove the components of the old elevator and thereafter to install components of the new elevator. For example, a new car is installed into a hoistway, a new hoisting machine into a machine room and a new roping is arranged to suspend the car. After this, the elevator is taken into use. Typically the building needs to stay in normal use during the modernizing process. A drawback has been that ability of the elevator group to serve is considerably reduced for the time of the modernization of an elevator of the group. Moreover, it may be necessary that workers performing the modernization may need to use the same elevator as the people living or working normally in the building.

BRIEF DESCRIPTION OF THE INVENTION

The object of the invention is to introduce an improved method for modernizing an elevator system comprising plurality of elevators. An object is particularly to introduce a solution by which one or more of the above defined problems of prior art and/or drawbacks discussed or implied elsewhere in the description can be solved. An object is particularly to make modernization of an elevator or elevators such that little disturbance is caused in the ability of the elevator system to serve transportation needs of its users.

It is brought forward a new method for modernizing an elevator system, which elevator system comprises a first elevator comprising a first car in a first hoistway, and a second elevator, comprising a second car in a second hoistway, the hoistways being in the same building. The traveling zones of said cars in particular overlap (when inspected from a side) at least partially. The method comprises using (also referred to as the first using) the first and second car for transporting passengers and/or goods between vertically displaced floors of a building, and thereafter removing the first elevator car from use for transporting passengers and/or goods between vertically displaced floors, and thereafter installing a construction time elevator into the lower end of the first hoistway, the traveling zone of the car of the construction time elevator covering only partially the height of the first hoistway; and thereafter using (also referred to as the second using) the car of the construction time elevator and the second car simultaneously for transporting passengers and/or goods between vertically displaced floors of the building, during which using the method preferably comprises performing construction work in the first hoistway above the traveling zone of the car of the construction time elevator, and preferably above the movable support structure of the elevator car; and thereafter changing the traveling zone of the car of the construction time elevator to extend higher in the hoistway, and thereafter using (also referred to as the third using) the car of the construction time elevator and the second car simultaneously for transporting passengers and/or goods between vertically displaced floors, during which using the method preferably comprises performing construction work in the first hoistway above the traveling zone of the car of the construction time elevator, and preferably above a movable support structure of the elevator car.

With this kind of solution one or more of the above mentioned objects can be achieved.

Preferable further details of the method are introduced in the following, which further details can be combined with the method individually or in any combination.

In a preferred embodiment, the first using comprises receiving a call from a user interface, and selecting by a controller (also referred to as a group controller) of a control system, which control system is configured to control movement of both the first car and the second car, an elevator car to be sent to serve the call, from a group of elevator cars the group including both the first car and the second car.

In a preferred embodiment, each said second using and/or each said third using comprises receiving a call from a user interface, and selecting by a controller (also referred to as a group controller) of a control system configured to control movement of both the car of the construction time elevator and the second car, an elevator car to be sent to serve the call, from a group of elevator cars the group including both the car of the construction time elevator and the second car. Thus elevators of an elevator system under modernization can operate efficiently as a group also during the modernization process.

In a preferred embodiment, the method comprises repeating one or more times said changing and third using.

In a preferred embodiment, during the second using and/or during each said third using the traveling zones of the car of the construction time elevator and the second car overlap (when inspected from a side) at least partially.

In a preferred embodiment, the method comprises, in particular after performing one or more times said changing and third using, converting the construction time elevator into a final elevator. Preferably, said converting comprises one or more of:

removing a movable support structure of the elevator car of the construction time elevator or at least parts thereof from the first hoistway;

removing a roping of the construction time elevator and installing a roping of the final elevator;

modifying roping ratio, preferably comprising making the suspension ratio of the elevator car of the final elevator to be 1:1, where the suspension ratio of the elevator car of the construction time elevator is n:1 where n is larger than 1;

removing a hoisting machine of the construction time elevator and installing a hoisting machine of the final elevator;

installing a hoisting machine of the final elevator, preferably into a machine room located above the first hoistway;

forming the car of the final elevator completely or at least partially of the car of the construction time elevator.

In a preferred embodiment, the installing a construction time elevator into the lower end of the first hoistway comprises mounting a movable support structure of an elevator car and preferably also of a counterweight in the first hoistway vertically supported on stationary structures. A hoisting machine of the construction time elevator for moving the car is preferably mounted on the movable support structure.

In a preferred embodiment, the method comprises removing a suspension roping of the first elevator before installing a construction time elevator into the lower end of the first hoistway.

In a preferred embodiment, the installing a construction time elevator into the lower end of the first hoistway comprises suspending an elevator car and preferably also a counterweight with a suspension roping from the aforementioned movable support structure. Preferably, the suspension roping extends through at least one a releasable rope clamp to a rope supply storage, which may be in the form of one or more rope reels, and where the additional rope needed in the method can be taken from. The rope supply storage can be preferably mounted on the movable support structure but alternatively elsewhere, such as on a landing or in the pit of the hoistway.

In a preferred embodiment, the installing a construction time elevator into the lower end of the first hoistway comprises removing at least partially guide rails of the first elevator such as guide rails of the first car and/or guide rails of the counterweight of the first elevator.

In a preferred embodiment, the installing a construction time elevator into the lower end of the first hoistway comprises installing guide rails of the construction time elevator into the first hoistway in particular one or more guide rails of the car and/or one or more guide rails of the counterweight of the construction time elevator.

In a preferred embodiment, the method preferably comprises removing the first car or at least parts thereof before installing a construction time elevator into the lower end of the first hoistway.

In a preferred embodiment, the installing a construction time elevator into the lower end of the first hoistway comprises installing a car of the construction time elevator into the first hoistway, and arranging it to move along one or more guide rails.

In a preferred embodiment, the method comprises one or more times, preferably before each said changing the traveling zone of the car to extend higher in the hoistway, hoisting the movable support structure for making room below it for enabling changing the traveling zone of the car to extend higher in the first hoistway, and mounting the movable support structure to a new higher position in the first hoistway vertically supported on stationary structures.

In a preferred embodiment, during each hoisting of the movable support structure, vertical movement of the movable support structure is guided by one or more guide rails, in particular by aid of one or more guides comprised in the movable support structure which one or more guides run along said one or more guide rails.

In a preferred embodiment, the moveable support structure comprises one or more releasable mounting mechanisms for releasably mounting the moveable support structure in the hoistway.

In a preferred embodiment, each said mounting of the movable support structure is performed with at least one releasable mounting mechanism.

In a preferred embodiment, the method comprises, in particular after at least a period of using the car of the construction time elevator and the second car simultaneously for transporting passengers and/or goods between vertically displaced floors, preferably after one or more aforementioned changings have been done, modernizing of the second elevator. The modernizing of the second elevator is preferably performed at least substantially similarly as the first elevator. The modernizing of the second elevator preferably comprises removing the second elevator car from use for transporting passengers and/or goods between vertically displaced floors, and thereafter installing a second construction time elevator into the lower end of the second hoistway, the traveling zone of the car of the second construction time elevator covering only partially the height of the second hoistway; and thereafter using (also referred to as the fourth using) the car of the second construction time elevator and a car installed and movable in the first hoistway, which preferably is the car of the construction time elevator or the car of the final elevator, simultaneously for transporting passengers and/or goods between vertically displaced floors of the building, during which using the method preferably comprises performing construction work in the second hoistway above the traveling zone of the car of the second construction time elevator, and in particular above a movable support structure of the elevator car of the second construction time elevator; and thereafter changing the traveling zone of the car of the second construction time elevator to extend higher in the second hoistway, and thereafter using (also referred to as the fifth using) the car of the second construction time elevator and the car in the first hoistway, which is preferably the car which is the car of the construction time elevator or the car of the final elevator, simultaneously for transporting passengers and/or goods between vertically displaced floors, during which using the method preferably comprises performing construction work in the second hoistway above the traveling zone of the car of the second construction time elevator and in particular above the movable support structure of the elevator car.

In a preferred embodiment, the method comprises repeating one or more times said changing and fifth using.

In a preferred embodiment, the method comprises, in particular after performing one or more times said changing and fifth using, converting the second construction time elevator into a final elevator. This can be performed correspondingly as above described for the construction time elevator. Preferably, this converting comprises one or more of:

- removing a movable support structure of the elevator car of the second construction time elevator or at least parts thereof from the second hoistway;
- removing a roping of the second construction time elevator and installing a roping of the final elevator:
- modifying roping ratio, preferably comprising making the suspension ratio of the elevator car of the final elevator to be 1:1, where the suspension ratio of the elevator car of the second construction time elevator is n:1 where n is larger than 1;
- removing a hoisting machine of the second construction time elevator and installing a hoisting machine of the final elevator;
- installing a hoisting machine of the final elevator, preferably into a machine room located above the second hoistway;
- forming the car of the final elevator completely or at least partially of the car of the second construction time elevator.

In a preferred embodiment, the group controller is configured to perform each aforementioned selecting an elevator car based on one or more variables, said one or more variables including the floor associated with the call.

In a preferred embodiment, the group controller is configured to perform said selecting, in particular during the second and/or third using, such that when the floor associated with the call is a floor above the traveling zone of the car of the construction time elevator, the controller is configured to select some other car of the group of cars than the car construction time elevator, preferably the second car or car of a yet further elevator.

In a preferred embodiment, the group controller is configured to perform said selecting, in particular during the second and/or third using, such that when the floor associated with the call is a floor within the traveling zone of the car of the construction time elevator, the controller is configured to be able to select the car of the construction time elevator.

In a preferred embodiment, the group controller is configured to perform said selecting an elevator car such that when the floor associated with the call is a floor within the traveling zone Z3 or Z5 of the car of the construction time elevator as well as the traveling zone Z2 of the second elevator, the controller prioritizes selecting the car of the construction time elevator over selecting the second car.

In a preferred embodiment, the group controller is configured to access, in particular during the second and/or third using, a list of floors, the list in particular being a list of floors within the traveling zone of the car of the construction time elevator. Thus, it can allocate cars in response to calls based on available floors.

In a preferred embodiment, the method, in particular the changing of the traveling zone of the car of the construction time elevator to extend higher in the hoistway, comprises updating a list of floors, the updating preferably including adding a floor to a list of floors, the list in particular being a list of floors within the traveling zone of the car of the construction time elevator.

In a preferred embodiment, the method comprises receiving calls as anywhere above mentioned defined from one or more user interface devices mounted at floors and/or from one or more user interface devices mounted in elevator cars and/or from one or more user portable interface devices, e.g. mobile phones or tablets.

In a preferred embodiment, each said call is in the form of call signal including a floor code, the floor code in particular indicating the destination floor or departing floor.

In a preferred embodiment, the uppermost floor present in the aforementioned list is higher after said updating than before said updating.

In a preferred embodiment, said performing construction work in the first hoistway above the traveling zone of the car of the construction time elevator and/or in the second hoistway above the traveling zone of the car of the second construction time elevator, comprises installing guide rails, such as guide rails of the car and/or counterweight above the traveling zone of the car in question. Preferably, the installing guide rails comprises installing guide rail sections on top of earlier installed guide rail sections.

In a preferred embodiment, the releasable mounting mechanism is shiftable between a first state and a second state, wherein said first state said mechanism engages a stationary structure to take support from it, and in said second state said mechanism is released from said engagement.

In a preferred embodiment, the aforementioned stationary structure is, and the aforementioned stationary structures include, one or more of the following: a hoistway wall, floor sill, a bracket by which a guide rail section of a rail line has been fixed to hoistway or a bracket fixed on a rail line e.g. for the purpose of supporting said movable machine room, or a guide rail section of a guider rail line.

In a preferred embodiment, the releasable mounting mechanism comprises an arm which is extendable to a first state where it vertically overlaps a bracket fixed stationary in hoistway, and retractable to a second state where it does not overlap said bracket so that it can bypass a bracket positioned above the aforementioned bracket when being hoisted together with the movable machine room.

In a preferred embodiment, the releasable mounting mechanism comprises an arm which is extendable to be on top of a structure of a floor sill or the hoistway wall, such as (in the latter case) on top of a surface of a pocket formed in the wall of the hoistway or a beam, for example, and retractable away from being on top of said structure of a floor sill or the hoistway wall.

In a preferred embodiment, each said releasable mounting mechanism comprises a gripper suitable for releasably gripping a guide rail section of a guide rail.

In a preferred embodiment, the aforementioned stationary structures include one or more of: a guide rail, a hoistway wall, a floor sill, a bracket by which a guide rail has been fixed to the hoistway, a bracket fixed on a rail e.g. for the purpose of supporting said movable machine room.

In a preferred embodiment, each selecting is performed in response to a receiving a call.

In a preferred embodiment, the first car and the second car and the car of the construction time elevator, preferably also the car of the second construction time elevator, each have an interior closable and openable with a door, the door preferably being an automatic door. The automatic door is preferably such that opening and closing of the door is automatically actuated by a door operator system, the actuator e.g. an electric motor, preferably being mounted on the car in question.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
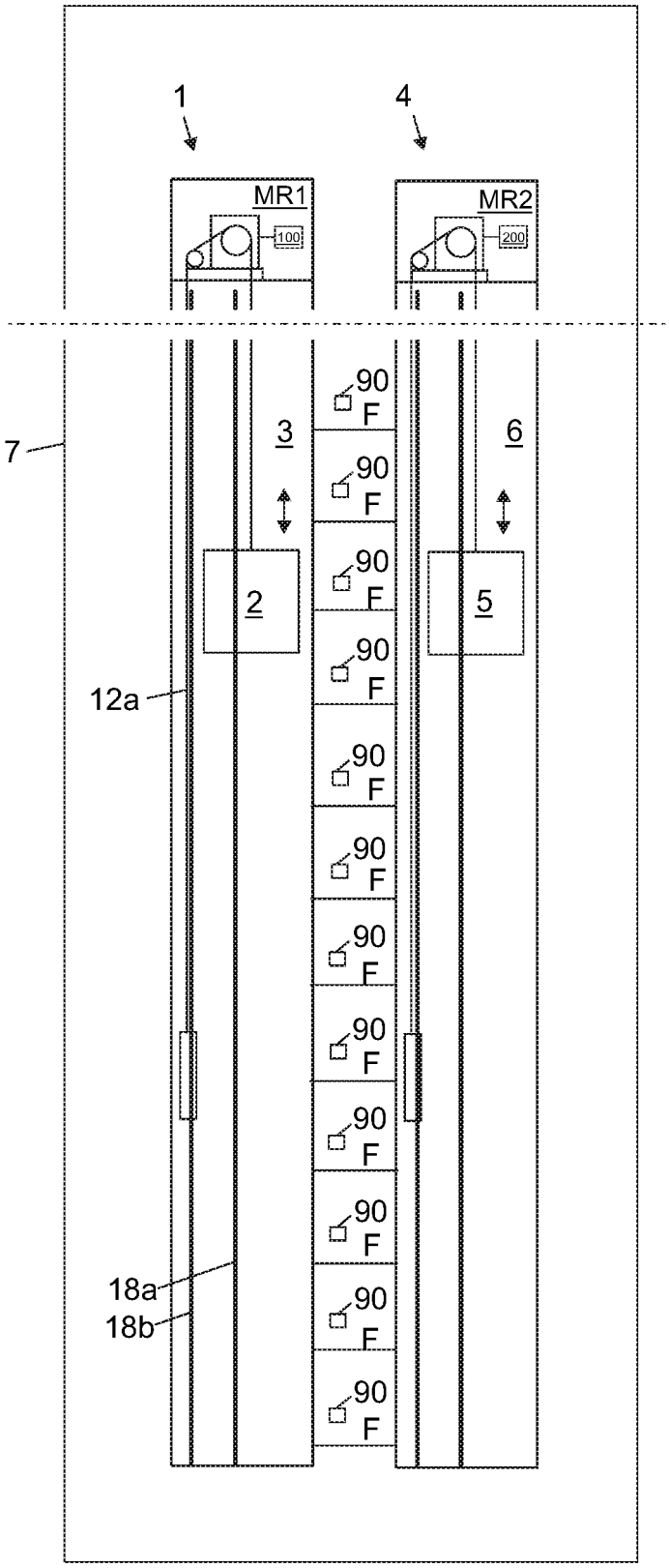
FIG. 1 illustrates an elevator system to be modernized.

FIG. 1 illustrates an elevator system to be modernized. The elevator system comprises a first elevator 1 comprising a first car 2 in a first hoistway 3, a second elevator 4, comprising a second car 5 in a second hoistway 6, the hoistways being in the same building 7. The building 7 comprises plurality of floors F. The traveling zones Z1,Z2 of said cars 2 and 5 overlap (when inspected from a side) at least partially. Thus they can serve one or more same floors. In the embodiment illustrated, the traveling zones Z1,Z2 of said cars 2 and 5 are similar.

The method for modernizing an elevator system comprises using (also referred to as the first using) the first and second car 2,5 for transporting passengers and/or goods between vertically displaced floors of a building 7, as indicated by arrows in FIG. 1. The elevators 1 and 4 preferably belong to a same elevator group. The first using comprises receiving a call from a user interface 90, and selecting by a controller 50 (also referred to as a group controller) of a control system S, which control system S is configured to control movement of both the first car 2 and the second car 5, an elevator car 2 or 5 to be sent to serve the call, from a group of elevator cars 2,5 the group including both the first car 2 and the second car 5.

Figure 2:
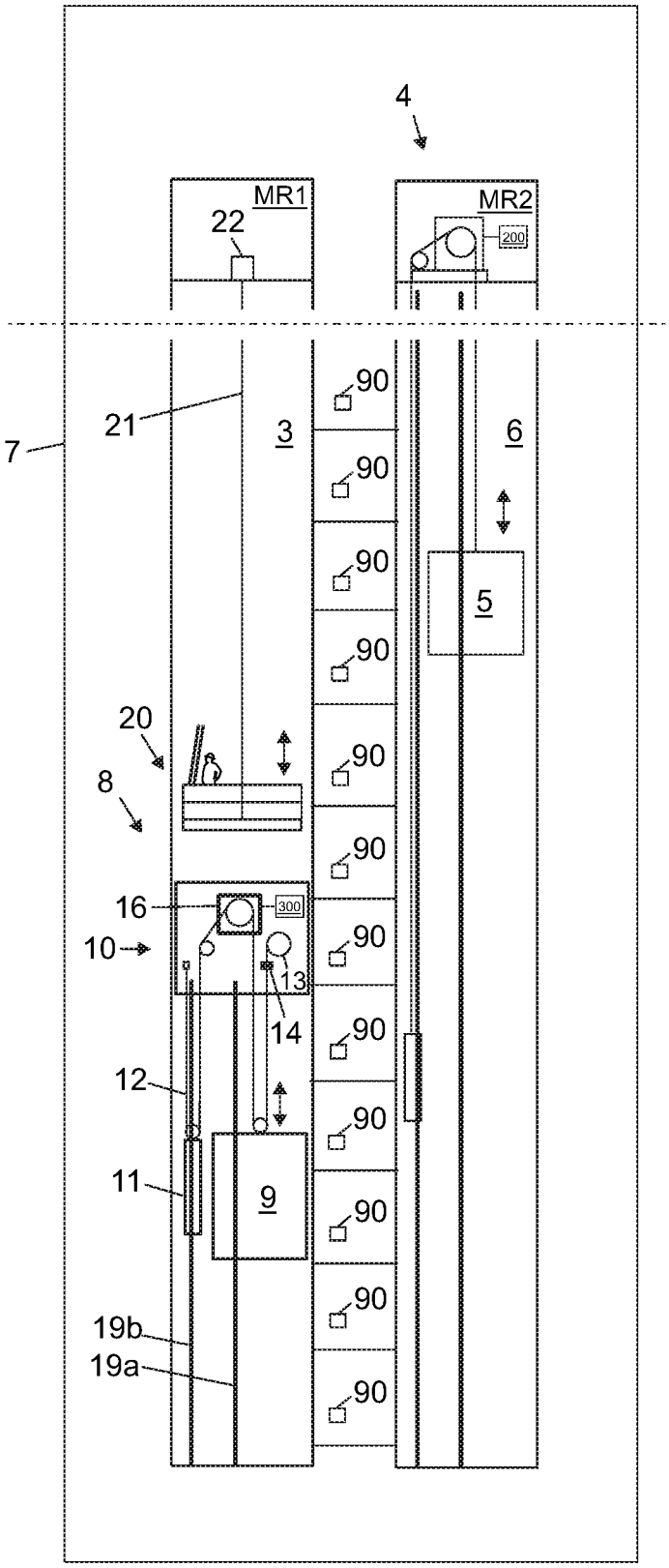
FIG. 2-4 illustrate the elevator system in phases of the method where a construction time elevator is in the first hoistway.

The method comprises after said first using, removing the first elevator car 2 from said use for transporting passengers and/or goods between vertically displaced floors, and thereafter installing a construction time elevator 8 into the lower end of the first hoistway 3, the traveling zone Z3 of the car 9 of the construction time elevator 8 covering only partially the height of the first hoistway 3; and thereafter using (also referred to as the second using) the car 9 of the construction time elevator 8 and the second car 5 simultaneously for transporting passengers and/or goods between vertically displaced floors of the building 7, during which using the method comprises performing construction work in the first hoistway 3 above the traveling zone Z3 of the car 9 of the construction time elevator 8, and in particular above a movable support structure 10 of the elevator car 9. These steps are illustrated in FIG. 2.

Said construction work in the first hoistway 3 above the traveling zone Z5 of the car 9 of the construction time elevator is performed working on a working platform 20, which is vertically movable up and down above the traveling zone Z3 of the car 9, and in particular vertically movable up and down above the movable support structure 10 of the elevator car 9. The working platform 20 is preferably movable by a hoisting arrangement 21,22 comprising a hoist 22 mounted in the machine room MR1 of the first elevator 1 above the hoistway 3, wherein the hoist 22 is connected with a cable or chain 21 to the working platform 20.

Preferred details of the aforementioned installing a construction time elevator 8 into the lower end of the first hoistway 3 are described hereinafter.

Preferably, the aforementioned installing a construction time elevator 8 into the lower end of the first hoistway 3 comprises mounting a movable support structure 10 of an elevator car 9 (and preferably also of a counterweight 11) in the first hoistway 3 vertically supported on stationary structures (not showed). FIG. 2 illustrates the movable support structure 10 in mounted state. A hoisting machine 16 of the construction time elevator 8 for moving the car 9 is preferably mounted on the movable support structure 10. Preferably, the aforementioned installing a construction time elevator 8 into the lower end of the first hoistway 3 comprises installing a controller 300 of the hoisting machine 16 of the construction time elevator 8. Preferably, the aforementioned installing a construction time elevator 8 comprises removing a controller 100 of the first elevator 1. These steps of replacing controller 100 with controller 300 are however not necessary as any needed changes could be also performed by reprogramming and/or rewiring.

The installing a construction time elevator 8 into the lower end of the first hoistway 3 moreover comprises suspending an elevator car 9 and preferably also a counterweight 11 with a suspension roping 12 from the movable support structure 10, as illustrated in FIG. 2. The suspension roping 12 extends through at least one a releasable rope clamp 14 to a rope supply storage 13, which may be in the form of one or more rope reels, and where the additional rope needed in the method can be taken from. The rope supply storage 13 can be preferably mounted on the movable support structure 10 but alternatively elsewhere, such as on a landing or in the pit of the hoistway 3.

The installing a construction time elevator 8 into the lower end of the first hoistway 3 moreover comprises removing at least partially guide rails 18*a*,18*b* of the first elevator 1 such as guide rails 18*a* of the first car and/or guide rails 18*b* of the counterweight of the first elevator and installing guide rails 19*a*,19*b* of the construction time elevator 8 into the first hoistway 3 in particular one or more guide rails 19*a* of the car 9 and/or one or more guide rails 19*b* of the counterweight 11 of the construction time elevator 8.

Preferably, the method comprises removing a suspension roping 12*a* of the first elevator 1 before said installing a construction time elevator 8 into the lower end of the first hoistway 3.

The installing a construction time elevator 8 into the lower end of the first hoistway 3 moreover comprises installing a car 9 of the construction time elevator (8) into the first hoistway (3), and arranging it to move along one or more guide rails (19*a*).

The elevators 8 and 4 preferably belong to a same elevator group. The second using comprises receiving a call from a user interface 90, and selecting by a controller 50 of a control system S', which control system S' is configured to control movement of both the car 9 of the construction time elevator 8 and the second car 5, an elevator car 9 or 5 to be sent to serve the call, from a group of elevator cars 9,5 the group including both the car 9 of the construction time elevator 8 and the second car 9.

Figure 3:
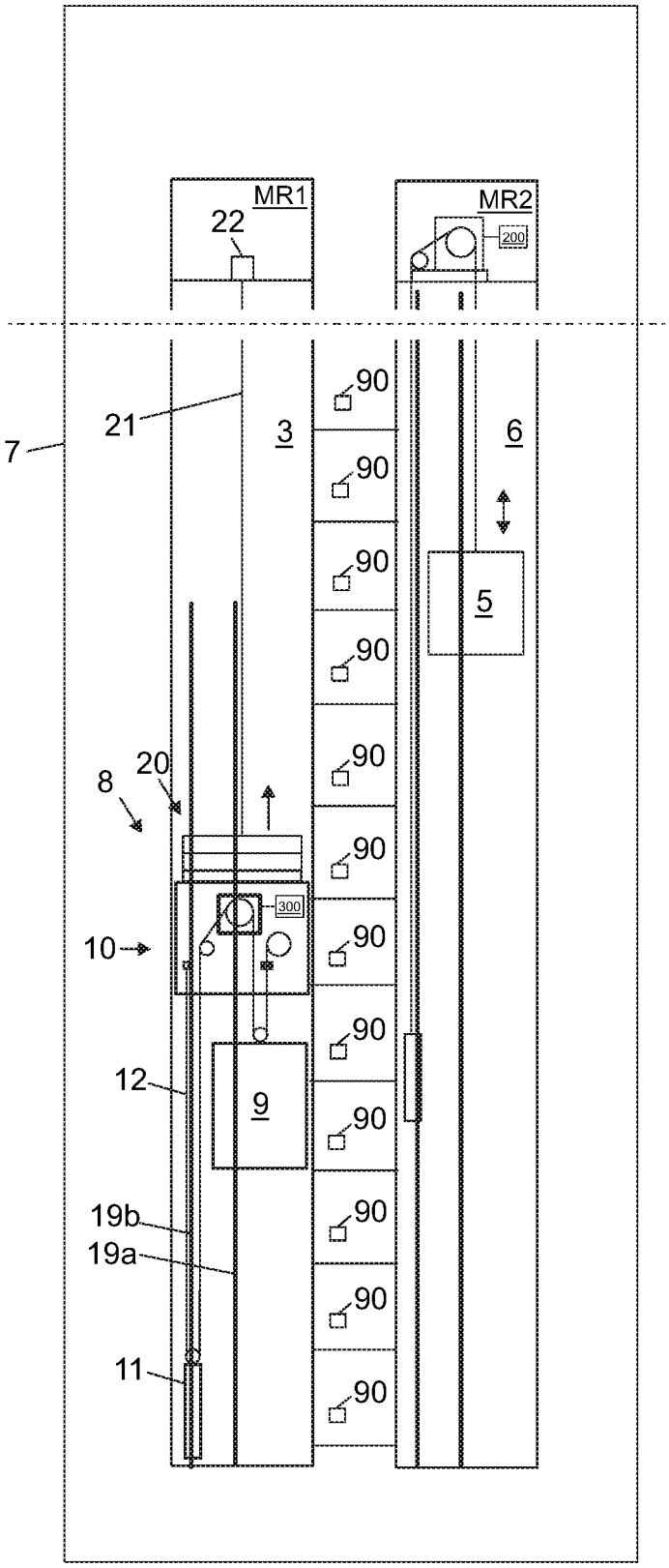
Figure 4:
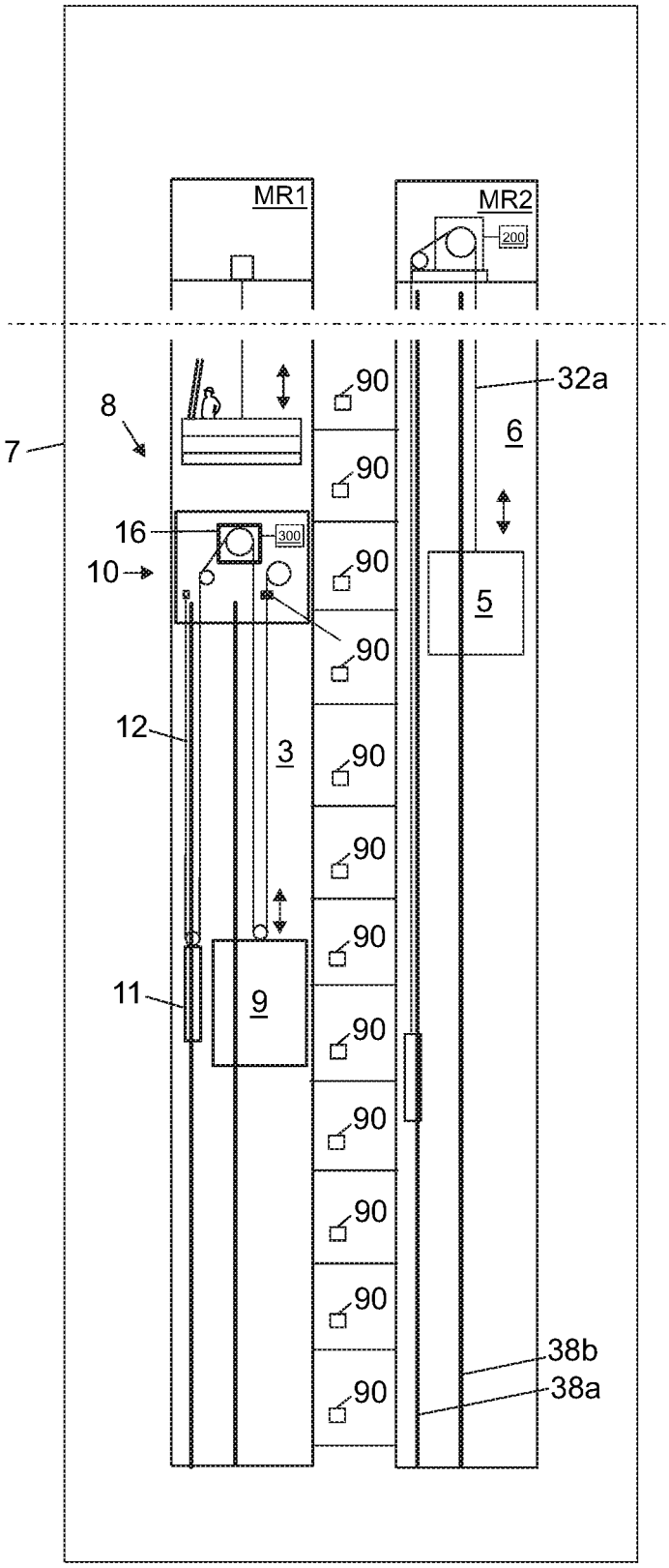

For facilitating a subsequent changing of the traveling zone of the car 9 of the construction time elevator 8 to extend higher in the hoistway 3, the method preferably comprises, in particular between the second using and said changing, hoisting the movable support structure 10 for making room below it for enabling changing the traveling zone of the car 9 to extend higher in the first hoistway 3, as illustrated in FIG. 3, and after said hoisting mounting the movable support structure 10 to a new higher position in the first hoistway 3 vertically supported on stationary structures. FIG. 4 illustrates the movable support structure 10 in this mounted state. The hoisting might not be necessary for facilitating changing the traveling zone of the car 9 if there is plenty of room between the movable support structure 10 and the traveling zone of the car 9.

The method comprises changing the traveling zone Z3 of the car 9 of the construction time elevator 8 to extend higher Z5 in the hoistway 3, which takes place after the second using. FIG. 4 illustrates the car 9 of the construction time elevator 8 having the traveling zone Z5 as changed in said changing. The changing of the traveling zone of the car 9 of the construction time elevator 8 to extend higher in the hoistway 3 preferably comprises updating a list of floors, such as a list of floors that are within the traveling zone Z5 of the car 9 of the construction time elevator 8, e.g. adding a floor to the list. The uppermost floor present in the list is preferably higher after said updating than before said updating. The changing can be made in the control system S' configured to control movement of both the car 9 of the construction time elevator 8 and the second car 5. The aforementioned list may then be stored in a memory of the control system S', for example.

After said changing, the method comprises using (also referred to as the a repeated second using) the car 9 of the construction time elevator 8 and the second car 5 simultaneously for transporting passengers and/or goods between vertically displaced floors, during which using the method comprises performing construction work in the first hoistway 3 above the traveling zone Z5 of the car 9 of the construction time elevator, and in particular above the movable support structure 10 of the elevator car 9. These steps are illustrated in FIG. 4.

The third using preferably comprises receiving a call from a user interface 90, and selecting by the controller 50 of a control system S', which control system S' is configured to control movement of both the car 9 of the construction time elevator 8 and the second car 5, an elevator car 9 or 5 to be sent to serve the call, from a group of elevator cars 9,5 the group including both the car 9 of the construction time elevator 8 and the second car 5.

Said construction work in the first hoistway 3 above the traveling zone Z5 of the car 9 of the construction time elevator is performed working on a working platform 20, which is vertically movable up and down above the traveling zone Z5 of the car 9, and in particular vertically movable up and down above the movable support structure 10 of the elevator car 9.

The method may comprise repeating one or more times said changing and third using. For facilitating the changings, the method preferably comprises, in particular between each third using and changing, hoisting the movable support structure 10 for making room below it for enabling changing the traveling zone of the car 9 to extend higher in the first hoistway 3.

Figure 5:
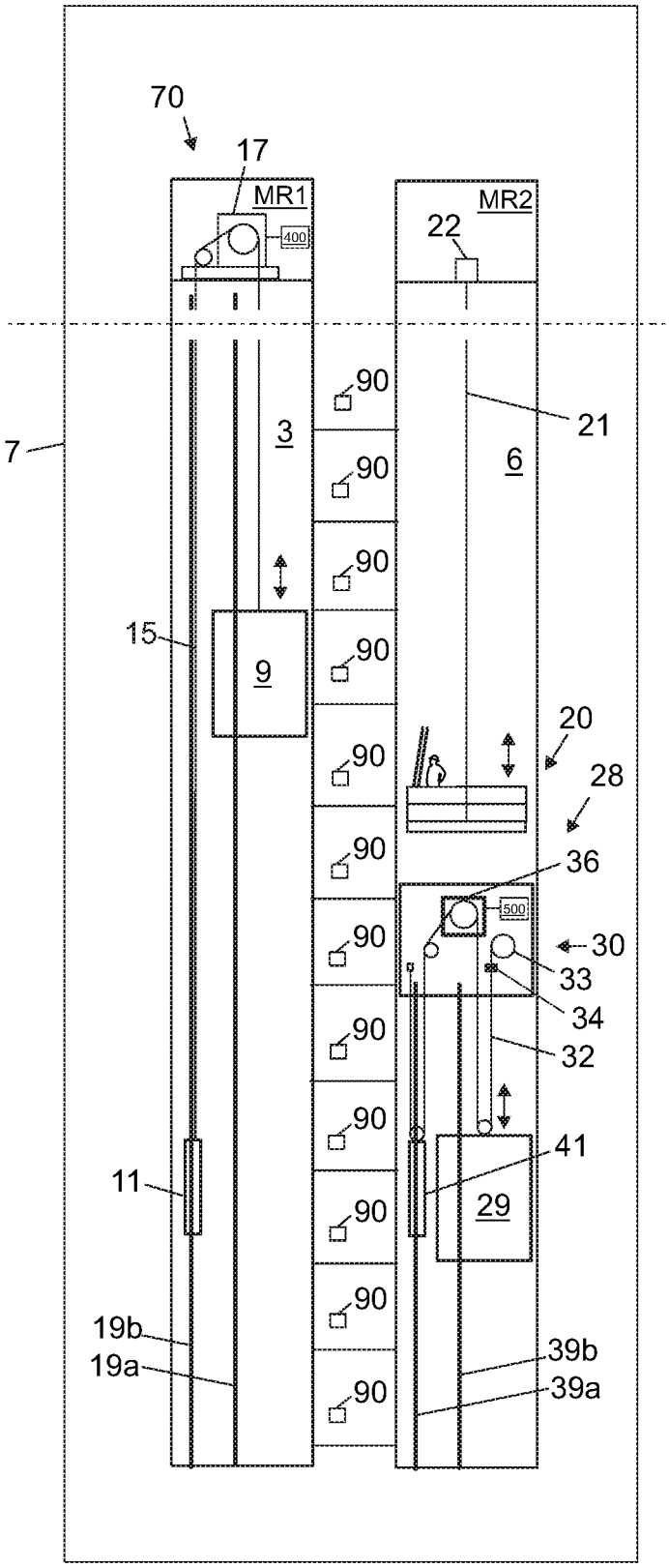
FIG. 5 illustrates the elevator system in phase where a final elevator is in the first hoistway and a second construction time elevator is in the second hoistway.

The method comprises, in particular after performing one or more times a changing and a third using, converting the construction time elevator 8 into a final elevator 70, as illustrated in FIG. 5.

In the preferred embodiment, illustrated in FIG. 5, said converting comprises:

- removing a movable support structure 10 of the elevator car 9 or at least parts thereof from the first hoistway 3; and
- removing a roping 12 of the construction time elevator 8 and installing a roping 15 of the final elevator 70; and
- modifying roping ratio, preferably comprising making the suspension ratio of the elevator car 9 of the final elevator to be 1:1, where the suspension ratio of the elevator car 9 of the construction time elevator 8 is n:1 where n is larger than 1; and
- removing a hoisting machine 16 of the construction time elevator 8; and
- installing a hoisting machine 17 of the final elevator 70 into a machine room MR1 located above the first hoistway 3; and
- removing a controller 300 of the hoisting machine 16 of the construction time elevator 8; and
- installing a controller 400 of the hoisting machine 17 of the final elevator 70; and
- forming the car 9 of the final elevator 70 completely or at least partially of the car 9 of the construction time elevator 8.

Generally, each performing construction work in the first hoistway 3 above the traveling zone of the car 9 of the construction time elevator 8 preferably comprises installing guide rails, such as guide rails 19*a* of the car 9 and/or guide rails 19*b* of the counterweight 11 above the (prevailing) traveling zone of the car 9 of the construction time elevator 8. Preferably, said installing guide rails 19*a*,19*b* comprises installing guide rail sections on top of earlier installed guide rail sections.

Preferred details of the group control implemented during the second and third using are described hereinafter.

Preferably, in each said second and third using the controller 50 is configured to perform said selecting an elevator car (5 or 9; 5 and 9) based on one or more variables, said one or more variables including the floor associated with the call. The association can be for example by a floor code. More specifically the selecting may comprise running an algorithm the details of which can be of any known kind, for example an algorithm in which floor associated with each call plays a role. Preferably, each said call is in the form of call signal including a floor code, in particular indicating the destination floor or departing floor, or possibly both. Particularly, the controller 50 is configured to perform said selecting such that when the floor associated with the call is a floor above the traveling zone Z3 or Z5 of the car 9 of the construction time elevator 8, the controller 50 is configured to select some other car of the group of cars than the car 9 construction time elevator 8, preferably the second car 5 or possibly a car of a yet further elevator. The controller 50 is moreover configured to perform said selecting such that when the floor associated with the call is a floor within the traveling zone Z3 or Z5 of the car 9 of the construction time elevator 8, the controller 50 is configured to be able to select the car 9 of the construction time elevator 8. Preferably, the controller 50 is configured to access a list of floors that are within the traveling zone (Z3 or Z5) of the car 9 of the construction time elevator 8. The list may be stored in a control system S' configured to control movement of both the car 9 of the construction time elevator 8 and the second car 5 for example. Preferably, the changing of the traveling zone Z3 of the car 9 of the construction time elevator 8 to extend higher Z5 in the hoistway 3, comprises updating the list, e.g. adding a floor to the list. Preferably, the uppermost floor present in the list is higher after said updating than before said updating.

Preferably, although not necessarily, the controller 50 is configured to perform said selecting an elevator car (5 or 9; 5 and 9) such that when the floor associated with the call is a floor within the traveling zone Z3 or Z5 of the car 9 of the construction time elevator 8 as well as the traveling zone Z2 of the second elevator 4, the controller 50 prioritizes selecting the car 9 of the construction time elevator 8 over selecting the second car 5. In this way the average passenger waiting time could be decreased compared to an exemplary situation where the elevator capable of serving the floors outside the traveling zone Z3 or Z5 of the construction time elevator 8 is selected by the controller 50 to serve a passenger destination call within the traveling zone of the construction time elevator while the construction time elevator is waiting in the lobby and during this a new passenger arrives to the lobby and gives a destination call outside the traveling zone Z3 or Z5 of the waiting construction time elevator.

Each first, second and third using comprises receiving calls as defined from one or more user interface devices 90 mounted at floors and/or from one or more user interface devices mounted in elevator cars and/or from one or more portable interface devices, e.g. mobile phones or tablets.

The method moreover comprises, at a suitable moment, in particular after at least a period of using the car 9 of the construction time elevator 8 and the second car 5 simultaneously for transporting passengers and/or goods between vertically displaced floors, preferably after one or more aforementioned changings have been done, modernizing of the second elevator 4. This modernization comprises removing the second elevator car 5 from use for transporting passengers and/or goods between vertically displaced floors, and thereafter installing a second construction time elevator 28 into the lower end of the second hoistway 6, the traveling zone Z7 of the car 29 of the second construction time elevator 28 covering only partially the height of the second hoistway 6, and thereafter using (also referred to as the fourth using) the car 29 of the second construction time elevator 28 and a car 9 installed and movable in the first hoistway 3, which may be the car 9 of the construction time elevator 8 or the car 9 of the final elevator, simultaneously for transporting passengers and/or goods between vertically displaced floors of the building 7, during which using the method comprises performing construction work in the second hoistway 6 above the traveling zone Z7 of the car 29 of the second construction time elevator 28, and in particular above the movable support structure 30 of the elevator car 29. These steps are illustrated in FIG. 5. Said suitable moment can be after converting the construction time elevator 8 into a final elevator 70, for instance. Thus, the second elevator 4 can be at service until the first elevator 1 has been modernized. However, said suitable moment can also be already before the modernization of elevator 1 has been finished.

Said construction work in the second hoistway 6 above the traveling zone Z7 of the car 29 of the construction time elevator is performed working on a working platform 20, which is vertically movable up and down above the traveling zone Z7 of the car 29, and in particular vertically movable up and down above a movable support structure 30 of the elevator car 29. The working platform 20 is preferably movable by a hoisting arrangement 21,22 comprising a hoist 22 mounted in the machine room MR2 of the second elevator 4 above the hoistway 6, wherein the hoist 22 is connected with a cable or chain 21 to the working platform 20.

Preferred details of the aforementioned installing a construction time elevator 28 into the lower end of the second hoistway 6 are described hereinafter.

Preferably, the aforementioned installing a construction time elevator 28 into the lower end of the first hoistway 6 comprises mounting a movable support structure of an elevator car 29 (and preferably also of a counterweight) in the second hoistway 6 vertically supported on stationary structures (not showed). FIG. 5 illustrates the movable support structure 30 in mounted state. A hoisting machine 36 of the construction time elevator 28 for moving the car 29 is preferably mounted on the movable support structure 30. Preferably, the aforementioned installing a construction time elevator 28 into the lower end of the second hoistway 6 comprises installing a controller 500 of the hoisting machine 36 of the second construction time elevator 28. Preferably, the aforementioned installing a construction time elevator 28 comprises removing a controller 200 of the second elevator 4. These steps of replacing controller 200 with controller 500 are however not necessary as any needed changes could be also performed by reprogramming and/or rewiring.

The installing a construction time elevator 28 into the lower end of the second hoistway 6 moreover comprises suspending an elevator car 29 and preferably also a counterweight 41 with a suspension roping 32 from the movable support structure 30, as illustrated in FIG. 5. The suspension roping 32 extends through at least one a releasable rope clamp 34 to a rope supply storage 33, which may be in the form of one or more rope reels, and where the additional rope needed in the method can be taken from. The rope supply storage 33 can be preferably mounted on the movable support structure 30 but alternatively elsewhere, such as on a landing or in the pit of the hoistway 6.

The installing a construction time elevator 28 into the lower end of the second hoistway 6 moreover comprises removing at least partially guide rails 38*a*,38*b* of the second elevator 4 such as guide rails 38*a* of the first car and/or guide rails 38*b* of the counterweight of the first elevator and installing guide rails 39*a*,39*b* of the construction time elevator 28 into the second hoistway 6 in particular one or more guide rails 39*a* of the car 29 and/or one or more guide rails 39*b* of the counterweight 41 of the construction time elevator 28.

Preferably, the method comprises removing a suspension roping 32*a* of the second elevator 4 before said installing a construction time elevator 28 into the lower end of the second hoistway 6.

The installing a second construction time elevator 28 into the lower end of the second hoistway 6 moreover comprises installing a car 29 of the construction time elevator 28 into the second hoistway 6, and arranging it to move along one or more guide rails 39*a*.

The elevators 28 and 70 preferably belong to a same elevator group. The fourth using comprises receiving a call from a user interface 90, and selecting by the controller 50 of a control system S", which control system S" is configured to control movement of both the car 29 of the second construction time elevator 28 and a car 9 installed and movable in the first hoistway 3, an elevator car 29 or 9 to be sent to serve the call, from a group of elevator cars 29,9 the group including both the car 29 of the second construction time elevator 28 and a car 9 installed and movable in the first hoistway 3.

Figure 6:
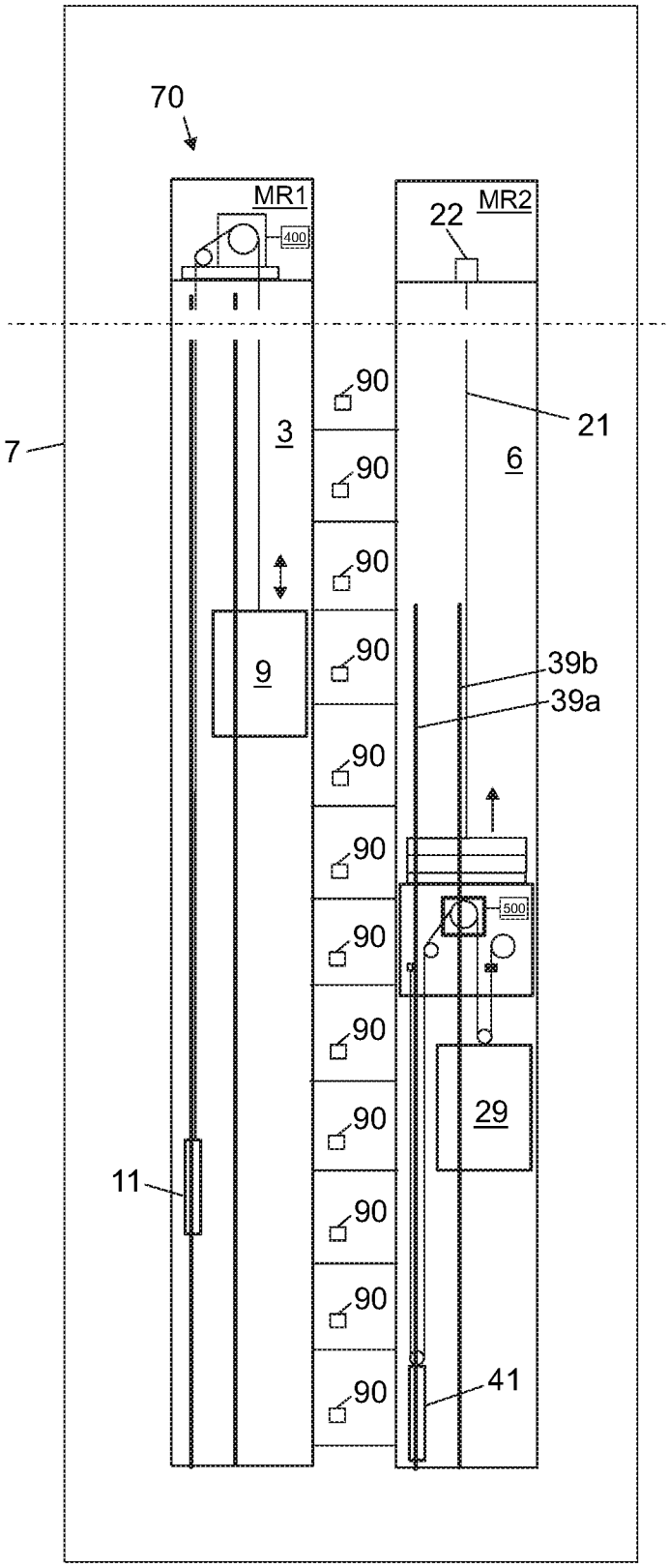
FIG. 6-7 illustrate the elevator system in phases of the method where a second construction time elevator is in the second hoistway.

For facilitating a subsequent changing of the traveling zone of the car 29 of the second construction time elevator 28 to extend higher in the hoistway 6, the method preferably comprises, in particular between the fourth using and said changing, hoisting the movable support structure 30 for making room below it for enabling changing the traveling zone of the car 29 to extend higher in the second hoistway 6, as illustrated in FIG. 6, and after said hoisting mounting the movable support structure 30 to a new higher position in the second hoistway 6 vertically supported on stationary structures. FIG. 6 illustrates the movable support structure 30 in this mounted state. The hoisting might not be necessary for facilitating changing the traveling zone of the car 29 if there is plenty of room between the movable support structure 30 and the traveling zone of the car 29.

Figure 7:
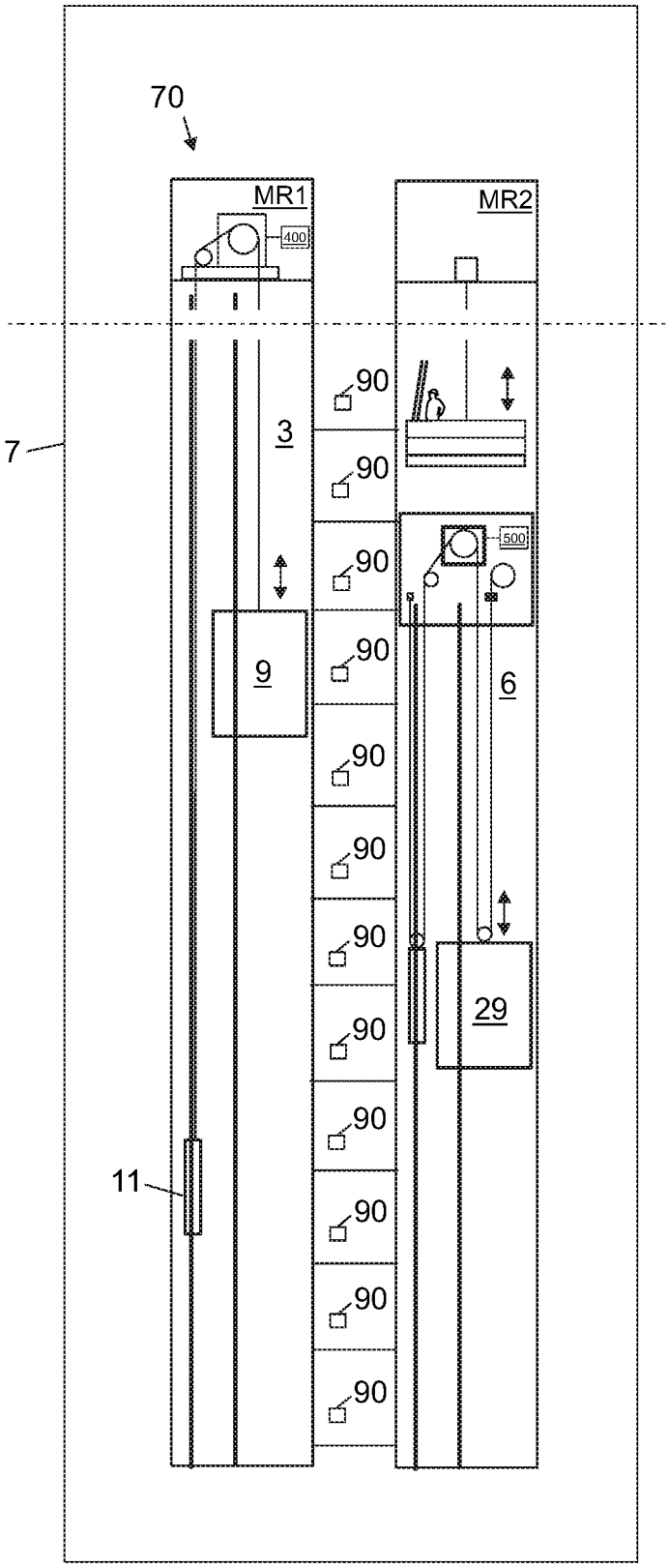

The method comprises changing the traveling zone Z7 of the car 29 of the second construction time elevator 28 to extend higher Z8 in the second hoistway 6. This takes place after the fourth using. FIG. 7 illustrates the car 29 of the second construction time elevator 28 having the traveling zone Z8 as changed in said changing.

The changing of the traveling zone of the car 29 of the second construction time elevator 28 to extend higher in the second hoistway 6 preferably comprises updating a list of floors, such as a list of floors that are within the traveling zone Z8 of the car 29 of the second construction time elevator 28, e.g. adding a floor to the list. The uppermost floor present in the list is preferably higher after said updating than before said updating. The changing can be made in the control system S" configured to control movement of both the car 29 of the second construction time elevator 28 and a car 9 installed and movable in the first hoistway 3. The aforementioned list may then be stored in a memory of the control system S", for example.

After said changing, the method comprises using (also referred to as the fifth using) the car 29 of the second construction time elevator 28 and the car 9 in the first hoistway 3, namely the car 9 which is the car of the construction time elevator or the car 9 of the final elevator 70, simultaneously for transporting passengers and/or goods between vertically displaced floors, during which using the method comprises performing construction work in the second hoistway 6 above the traveling zone Z8 of the car 29 of the second construction time elevator, and in particular above the movable support structure 30 of the elevator car 29. These steps are illustrated in FIG. 7.

Said construction work in the second hoistway 6 above the traveling zone Z8 of the car 29 of the second construction time elevator 28 is performed working on a working platform 20, which is vertically movable up and down above the traveling zone Z8 of the car 29, and in particular vertically movable up and down above the movable support structure 30 of the elevator car 29.

The method may comprise repeating one or more times said changing and fifth using. For facilitating the changings, the method preferably comprises, in particular between each fifth using and changing, hoisting the movable support structure 30 for making room below it for enabling changing the traveling zone of the car 29 to extend higher in the second hoistway 6.

Figure 8:
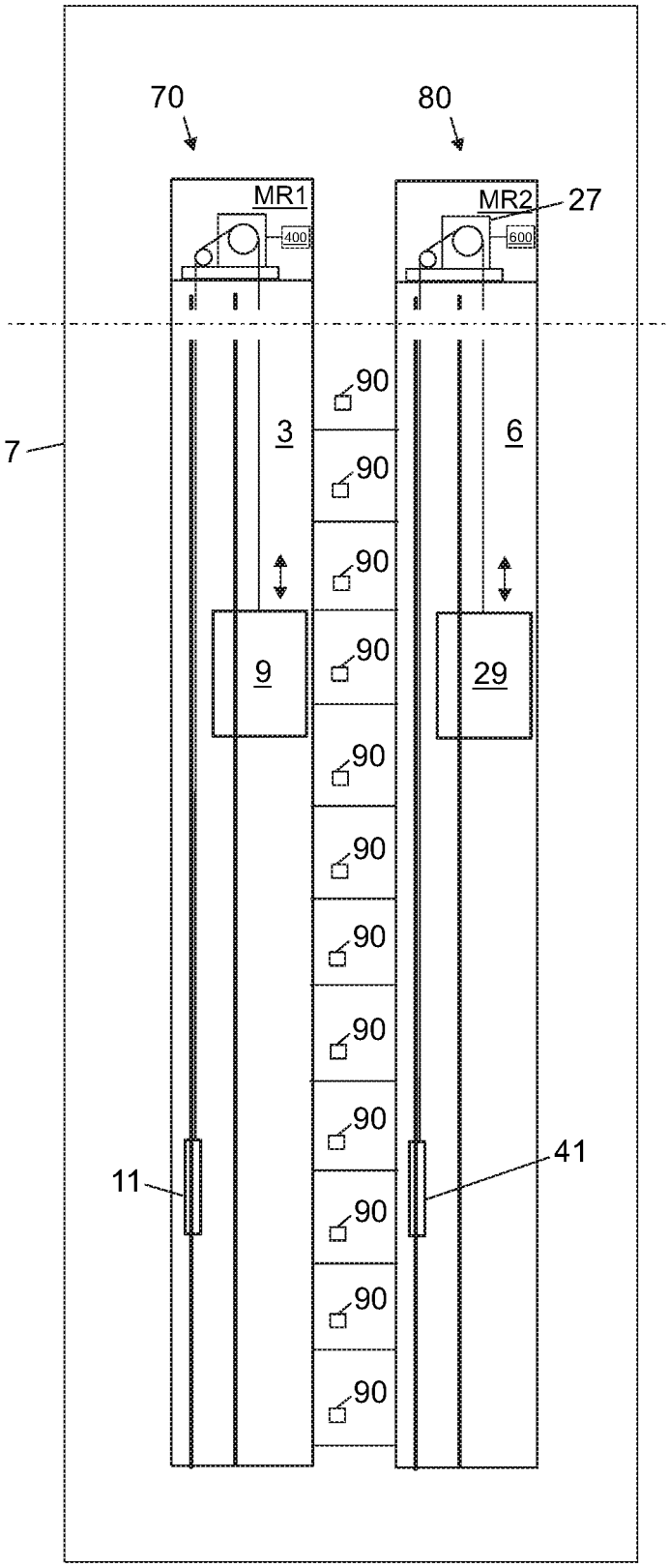
FIG. 8 illustrates the elevator system in a phase where a final elevator is in the first and second hoistway.
Figure 9:
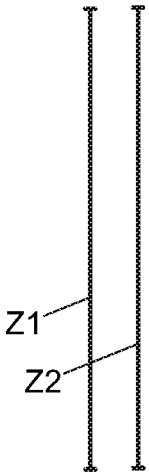
FIG. 9 illustrates traveling zones of the cars of FIG. 1.
Figure 10:
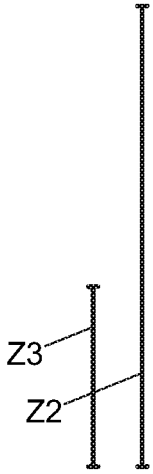
FIG. 10 illustrates traveling zones of the cars of FIG. 2.
Figure 11:
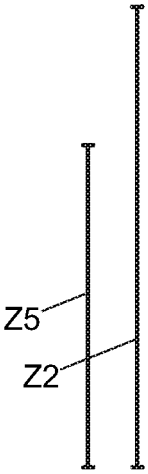
FIG. 11 illustrates traveling zones of the cars of FIG. 4.
Figure 12:
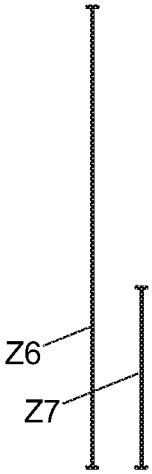
FIG. 12 illustrates traveling zones of the cars of FIG. 5.
Figure 13:
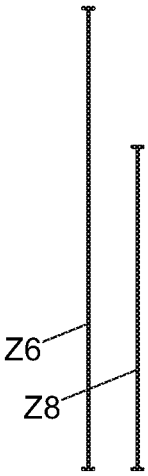
FIG. 13 illustrates traveling zones of the cars of FIG. 7.
Figure 14:
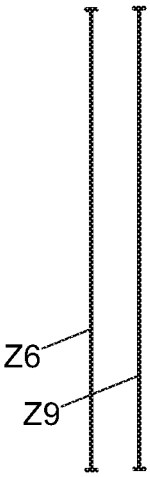
FIG. 14 illustrates traveling zones of the cars of FIG. 8.
Figure 15:
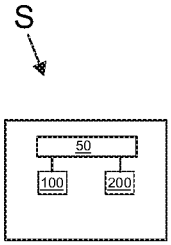
FIG. 15 illustrates a control system of the elevator system at the phase of FIG. 1.
Figure 16:
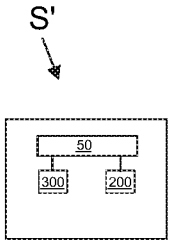
FIG. 16 illustrates a control system of the elevator system at the phases of FIGS. 2-4.
Figure 17:
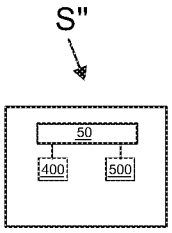
FIG. 17 illustrates a control system of the elevator system at the phases of FIGS. 5-7.
Figure 18:
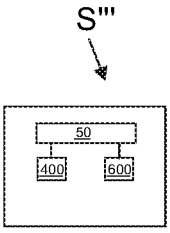
FIG. 18 illustrates a control system of the elevator system at the phase of FIG. 8.

The method comprises, in particular after performing one or more times a changing and a fifth using, converting the second construction time elevator 28 into a final elevator 80, as illustrated in FIG. 8.

In the preferred embodiment, illustrated in FIG. 8, said converting comprises:

- removing a movable support structure 30 of the elevator car 29 or at least parts thereof from the second hoistway 6; and
- removing a roping 32 of the second construction time elevator 28 and installing a roping of the final elevator 80; and
- modifying roping ratio, preferably comprising making the suspension ratio of the elevator car 29 of the final elevator to be 1:1, where the suspension ratio of the elevator car 29 of the second construction time elevator 28 is n:1 where n is larger than 1;
- removing a hoisting machine 36 of the second construction time elevator 28; and
- installing a hoisting machine 27 of the final elevator 80 into a machine room MR2 located above the second hoistway 6; and
- removing a controller 500 of the hoisting machine 36 of the second construction time elevator 28; and
- installing a controller 600 of the hoisting machine 27 of the final elevator 80;
- forming the car 29 of the final elevator 80 completely or at least partially of the car 29 of the construction time elevator 28.

Generally, each performing construction work in the second hoistway 6 above the traveling zone of the car 29 of the construction time elevator 28 preferably comprises installing guide rails, such as guide rails 39*a* of the car 29 and/or guide rails 39*b* of the counterweight 41 above the (prevailing) traveling zone of the car 29 of the construction time elevator 28. Preferably, said installing guide rails 39*a*,39*b* comprises installing guide rail sections on top of earlier installed guide rail sections.

In the method, preferably during each hoisting of the movable support structure 10; 30, vertical movement of the movable support structure 10; 30 is guided by one or more guide rails 19*a*,19*b*; 39*a*,39*b*, in particular by aid of one or more guides (not showed) comprised in the movable support structure 10; 30 which one or more guides run along said one or more guide rails 19*a*,19*b*; 39*a*,39*b*. The guides can be roller guides or slide guides, for example.

Generally, for enabling releasable, and thereby a temporary mounting, the movable machine room 10; 30 comprises one or more releasable mounting mechanisms for releasably mounting the movable machine room 10; 30 vertically supported in the hoistway 3; 6. Each said mounting of the movable support structure is then performed with at least one releasable mounting mechanism.

The releasable mounting mechanism is preferably shiftable between a first state and a second state, where in said first state said mechanism engages a stationary structure to take support from it, and in said second state said mechanism is released from said engagement.

Preferably, the aforementioned stationary structures include one or more of: a guide rail, a hoistway wall, a floor sill, a bracket by which a guide rail has been fixed to the hoistway, a bracket fixed on a rail e.g. for the purpose of supporting said movable machine room.

In a first alternative, the releasable mounting mechanism cab comprise an arm which is extendable to a first state where it vertically overlaps a bracket fixed stationary in hoistway, and retractable to a second state where it does not overlap said bracket so that it can bypass a bracket positioned above the aforementioned bracket when being hoisted together with the movable machine room.

In a second alternative, the releasable mounting mechanism comprises an arm which is extendable to be on top of a structure of a floor sill or the hoistway wall, such as (in the latter case) on top of a surface of a pocket formed in the wall of the hoistway or a beam, for example, and retractable away from being on top of said structure of a floor sill or the hoistway wall.

In a third alternative, each said releasable mounting mechanism comprises a gripper suitable for releasably gripping a guide rail. In this case, the first state of the releasable mounting mechanism is a state where the gripper grips a guide rail 19*a*,19*b*; 39*a*,39*b* with gripping members on opposite sides of the guide rail, and the second state a state where said gripper does not grip a guide rail 19*a*,19*b*; 39*a*,39*b*. Generally, a gripper suitable for releasably gripping a guide rail 19*a*,19*b*; 39*a*,39*b* can be implemented with a wedging gripper wedging direction being downwards direction or alternatively with a fixed caliper brake or a floating caliper brake, for example.

Generally, the hoisting of the movable support structure 10; 30 can be implemented in any of many different alternative ways known in the field. In the embodiment illustrated in FIGS. 3 and 6, the hoisting is performed using a hoisting arrangement 21,22 comprising a hoist 22 mounted in the machine room MR1; MR2 of the elevator 1; 4 under modernization, which machine room MR1; MR2 is disposed above the hoistway 3; 6 of the elevator 1; 4 under modernization, wherein the hoist 22 is connected in a force transmitting manner to the movable support structure 10; 30 with a cable or chain. This is implemented in FIGS. 3 and 6 using the hoisting arrangement 21,22 of the working platform 20, in particular such that for the time of the hoisting of the movable support structure 10; 30, the working platform 20 is fixed to the movable support structure 10; 30 whereby the hoisting arrangement 21,22 is connected in a force transmitting manner to movable support structure 10; 30 via the working platform 20.

In this application, a traveling zone of a car is deemed to be a zone between the uppermost and lowermost floor where a control system (i,e. in the embodiments the elevator system S,S', S", S'" whichever is prevailing) can move the car in question.

Preferably, in general when an elevator car is sent to serve a call, it is sent to a floor associated with the call. The association can be for example by a floor code.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. A method for modernizing an elevator system, which the elevator system comprising a first elevator comprising a first car in a first hoistway, and a second elevator, comprising a second car in a second hoistway, the method comprising the steps of:

using (the first using) the first and the second car for transporting passengers and/or goods between vertically displaced floors of a building, and thereafter removing the first elevator car from use for transporting passengers and/or goods between vertically displaced floors, and thereafter installing a construction time elevator into a lower end of the first hoistway, the traveling zone of the car of the construction time elevator covering only partially a height of the first hoistway; and thereafter using (the second using) the car of the construction time elevator and the second car simultaneously for transporting passengers and/or goods between vertically displaced floors of the building, and thereafter changing the traveling zone of the car of the construction time elevator to extend higher in the hoistway, and thereafter using (third using) the car of the construction time elevator and the second car simultaneously for transporting passengers and/or goods between vertically displaced floors.

2. The method according to claim 1, wherein during the second using the method comprises the step of performing construction work in the first hoistway above the traveling zone of the car of the construction time elevator.

3. The method according to claim 1, wherein during the third using the method comprises the step of performing construction work in the first hoistway above the traveling zone of the car of the construction time elevator.

4. The method according to claim 1, wherein the first using comprises receiving a call from a user interface, and selecting by a controller of a control system, the control system being configured to control movement of both the first car and the second car, an elevator car to be sent to serve the call, from a group of elevator cars, the group including both the first car and the second car.

5. The method according to claim 4, wherein the controller is configured to perform said selecting an elevator car based on one or more variables, said one or more variables including the floor associated with the call.

6. The method according to claim 4, wherein the controller is configured to perform each said selecting such that when the floor associated with the call is a floor above the traveling zone of the car of the construction time elevator, the controller is configured to select some other car of the group of cars than the car construction time elevator, preferably the second car or car of a yet further elevator.

7. The method according to claim 4, wherein the controller is configured to perform said selecting such that when the floor associated with the call is a floor within the traveling zone of the car of the construction time elevator, the controller is configured to be able to select the car of the construction time elevator.

8. The method according to claim 4, wherein the controller is configured to access a list of floors within the traveling zone of the car of the construction time elevator.

9. The method according to claim 1, wherein each said second and/or third using comprises receiving a call from a user interface, and selecting by a controller of a control system configured to control movement of both the car of the construction time elevator and the second car, an elevator car to be sent to serve the call, from a group of elevator cars, the group including both the car of the construction time elevator and the second car.

10. The method according to claim 1, wherein the method comprises after performing one or more times said changing and third using, converting the construction time elevator into a final elevator.

11. The method according to claim 1, wherein said converting comprises one or more of:

removing a movable support structure of the elevator car or at least parts thereof from the first hoistway;

removing a roping of the construction time elevator and installing a roping of the final elevator;

modifying a roping ratio, where the suspension ratio of the elevator car of the construction time elevator is n:1 where n is larger than 1;

removing a hoisting machine of the construction time elevator and installing a hoisting machine of the final elevator;

installing a hoisting machine of the final elevator; and forming the car of the final elevator completely or at least partially of the car of the construction time elevator.

12. The method according to claim 11, wherein the step of modifying a roping ratio comprises making the suspension ratio of the elevator car of the final elevator to be 1:1.

13. The method according to claim 11, wherein the step of installing a hoisting machine of the final elevator comprises installing the hoisting machine into a machine room located above the first hoistway.

14. The method according to claim 1, wherein the installing a construction time elevator into the lower end of the first hoistway comprises mounting a movable support structure of an elevator car in the first hoistway vertically supported on stationary structures.

15. The method according to claim 1, wherein the installing a construction time elevator into the lower end of the first hoistway comprises suspending an elevator car with a suspension roping from the movable support structure.

16. The method according to claim 1, wherein the installing a construction time elevator into the lower end of the first hoistway comprises installing a car of the construction time elevator into the first hoistway, and arranging the car to move along one or more guide rails.

17. The method according to claim 1, wherein the method comprises one or more times, hoisting the movable support structure for making room below the movable support structure for enabling changing the traveling zone of the car to extend higher in the first hoistway, and mounting the movable support structure to a new higher position in the first hoistway vertically supported on stationary structures.

18. The method according to claim 1, wherein the method comprises, after at least a period of using the car of the construction time elevator and the second car simultaneously for transporting passengers and/or goods between vertically displaced floors, after one or more of the changings have been done, modernizing of the second elevator.

19. The method according to claim 1, wherein the method comprises, a modernizing of the second elevator comprising:

removing the second elevator car from use for transporting passengers and/or goods between vertically displaced floors; and thereafter installing a second construction time elevator into the lower end of the second hoistway, a traveling zone of the car of the second construction time elevator covering only partially a height of the second hoistway; and thereafter using (fourth using) the car of the second construction time elevator and a car installed and movable in the first hoistway, which is the car of the construction time elevator or the car of a final elevator, simultaneously for transporting passengers and/or goods between vertically displaced floors of the building; and thereafter changing the traveling zone of the car of the second construction time elevator to extend higher in the second hoistway; and thereafter using (fifth using) the car of the second construction time elevator and the car installed and movable in the first hoistway, which is the car of the construction time elevator or the car of the final elevator, simultaneously for transporting passengers and/or goods between vertically displaced floors.

20. The method according to claim 19, wherein during the fourth step of using, the method comprises performing construction work in the second hoistway above the traveling zone of the car of the second construction time elevator, and above a movable support structure of the elevator car.

21. The method according to claim 19, wherein during the fifth step of using, the method comprises performing construction work in the second hoistway above the traveling zone of the car of the second construction time elevator and above a movable support structure of the elevator car.

22. The method according to claim 1, wherein the changing of the traveling zone of the car of the construction time elevator to extend higher in the hoistway, comprises updating a list of floors, the updating including adding a floor to the list.

* * * * *